US007161554B2

(12) United States Patent
Nugnes et al.

(10) Patent No.: US 7,161,554 B2
(45) Date of Patent: Jan. 9, 2007

(54) SYSTEM AND METHOD FOR SECURING AN ANTENNA

(75) Inventors: James J. Nugnes, Hooksett, NH (US); Adam M. Alevy, Carlisle, MA (US); Shawn W. Johnson, Allenstown, NH (US)

(73) Assignee: Cushcraft Corporation, Manchester, NH (US)

( * ) Notice: Subject to any disclaimer, the term of this patent is extended or adjusted under 35 U.S.C. 154(b) by 0 days.

(21) Appl. No.: 10/974,585

(22) Filed: Oct. 27, 2004

(65) Prior Publication Data

US 2005/0093764 A1 May 5, 2005

Related U.S. Application Data

(60) Provisional application No. 60/515,929, filed on Oct. 30, 2003.

(51) Int. Cl.
*H01Q 1/12* (2006.01)

(52) U.S. Cl. ..... 343/878

(58) Field of Classification Search ..... 343/878, 343/892, 882, 890, 891; 248/317, 68.1, 285
See application file for complete search history.

(56) References Cited

U.S. PATENT DOCUMENTS

| | | | | |
|---|---|---|---|---|
| 4,715,161 | A | 12/1987 | Carraro et al. | 52/714 |
| 4,723,749 | A | 2/1988 | Carraro et al. | 248/317 |
| 5,453,756 | A | 9/1995 | Lowrey | 343/892 |
| 5,506,593 | A * | 4/1996 | Peng | 343/888 |
| 5,619,217 | A | 4/1997 | Mailandt et al. | 343/872 |
| 5,661,802 | A | 8/1997 | Nilssen | 380/20 |
| 6,190,198 | B1 * | 2/2001 | Ray | 439/532 |
| 6,198,460 | B1 * | 3/2001 | Brankovic | 343/879 |
| 6,295,036 | B1 * | 9/2001 | Mata et al. | 343/878 |
| 6,361,007 | B1 | 3/2002 | Oby et al. | 248/285 |
| 6,369,766 | B1 | 4/2002 | Strickland et al. | 343/713 |
| 6,563,465 | B1 | 5/2003 | Frecska | 343/700 MS |
| 6,788,256 | B1 * | 9/2004 | Hollister | 343/700 MS |
| 6,937,207 | B1 * | 8/2005 | Sergi | 343/878 |
| 2002/0050955 | A1 | 5/2002 | Strickland et al. | 343/895 |
| 2002/0105476 | A1 | 8/2002 | Overton | 343/892 |
| 2003/0089828 | A1 | 5/2003 | Korczak et al. | 248/68.1 |
| 2003/0103008 | A1 | 6/2003 | Petropoulos et al. | 343/702 |
| 2004/0066353 | A1 * | 4/2004 | Ernest et al. | 343/891 |

* cited by examiner

*Primary Examiner*—Trinh Dinh
*Assistant Examiner*—Huedung Mancuso
(74) *Attorney, Agent, or Firm*—Hayes Soloway PC

(57) ABSTRACT

A bracket for securing an antenna to a ceiling grid system has a first opening to allow the bracket to be secured to a connector mechanically coupled to the ceiling grid system and a second opening to allow an electrical connection to pass therethrough. The second opening is offset a distance from the first opening to allow the electrical connection to extend upwardly without being obstructed by the ceiling grid.

18 Claims, 8 Drawing Sheets

SYSTEM AND METHOD FOR SECURING AN ANTENNA

CROSS-REFERENCE TO RELATED APPLICATION

This application claims priority to copending U.S. Provisional Application entitled, "System and Method for Securing an Antenna to a Ceiling Grid", having Ser. No. 60/515,929, filed Oct. 30, 2003, which is entirely incorporated herein by reference.

FIELD OF THE INVENTION

The present invention relates generally to brackets and, more particularly, to brackets for securing an antenna to a ceiling grid.

BACKGROUND

Wireless networks have become increasingly more popular. Computers and other electronic devices dispersed throughout a building may communicate with each other without having to be directly connected by a communications wire. These wireless networks may have one or more antennas located throughout a building to provide appropriate coverage. The antennas may be mounted out of sight in a closet or utility room, or may be mounted in space, for example, the antenna may be mounted in the middle of a room from the ceiling. Antennas are available in a variety of different shapes and may be mounted in a variety of orientations. For example, the antenna shape may be an elongated cylinder with an electrical connection extending from one end. An electrical connection extending from an antenna may present problems when a user attempts to couple the antenna to a ceiling or ceiling grid.

Suspended ceilings have been used in residential and commercial applications to provide a clean overhead appearance in a variety of rooms. The suspended ceiling system may be made up of a ceiling grid and acoustic tiles. The ceiling grid is typically made up of "L" brackets and "T" bars. The "L" brackets are typically coupled to walls along the perimeter of a room with nails or screws. The "T" bar may rest on the "L" brackets, and may be secured to overhead rafters or other permanent structures with cables. The "T" brackets are typically arranged in a rectangular grid with the acoustic tiles being supported along their perimeter by the "T" brackets and "L" brackets.

FIG. 1 is an isometric view of a first connector assembly 100 for securing items to a ceiling grid. The connector 100 is available from the Electric Railway Improvement Company in Solon, Ohio, under the trademark Caddy® twist on fixture support. The connector assembly 100 has a grasping portion 102, a downwardly directed threaded rod portion 104, and a wing nut 106. The connector assembly 100 may be secured to a "T" bar 110 by rotating the grasping portion 102 counterclockwise. Items may be secured to the connector assembly 100 using the wing nut 106.

There is a need for an antenna mounting system that can couple an antenna to a ceiling grid.

BRIEF SUMMARY OF THE INVENTION

Embodiments of the present invention provide a system and method for securing an antenna to a ceiling grid.

Briefly described, in architecture, one embodiment of the system, among others, can be implemented as follows. A bracket having a first opening at a proximal end, a second opening at a distal end, a third opening at the distal end, and a slot extending outwardly from the third opening to an outside edge.

The present invention can also be viewed as providing a method of securing an antenna to an overhead ceiling grid, comprising the steps of coupling a connector assembly with a downwardly extending threaded rod portion to the overhead ceiling grid, coupling a bracket to the downwardly extending threaded rod portion, with a fastener, extending an electrical connection through an opening in the bracket, and coupling the antenna to the bracket with one or more fasteners extending through the bracket and into a distal end of the antenna.

Other systems, methods, features, and advantages of the present invention will be, or will become apparent, to one with skill in the art upon examination of the following drawings and detailed description. It is intended that all such additional systems, methods, features, and advantages included within this description, be within the scope of the present invention, and be protected by the accompanying claims.

BRIEF DESCRIPTION OF THE DRAWINGS

Many aspects of the invention can be better understood with reference to the following drawings. Components in the drawings are not necessarily to scale, emphasis instead being placed upon clearly illustrating principles of the present invention. Moreover, in the drawing, like-referenced numerals designate corresponding parts throughout the several views.

DETAILED DESCRIPTION

The present invention is a system and method for securing an antenna to a ceiling grid. Specifically, the system and method may be used to secure an antenna to an overhead ceiling grid, for example, a suspended ceiling grid for supporting acoustic tiles.

Figure 1:
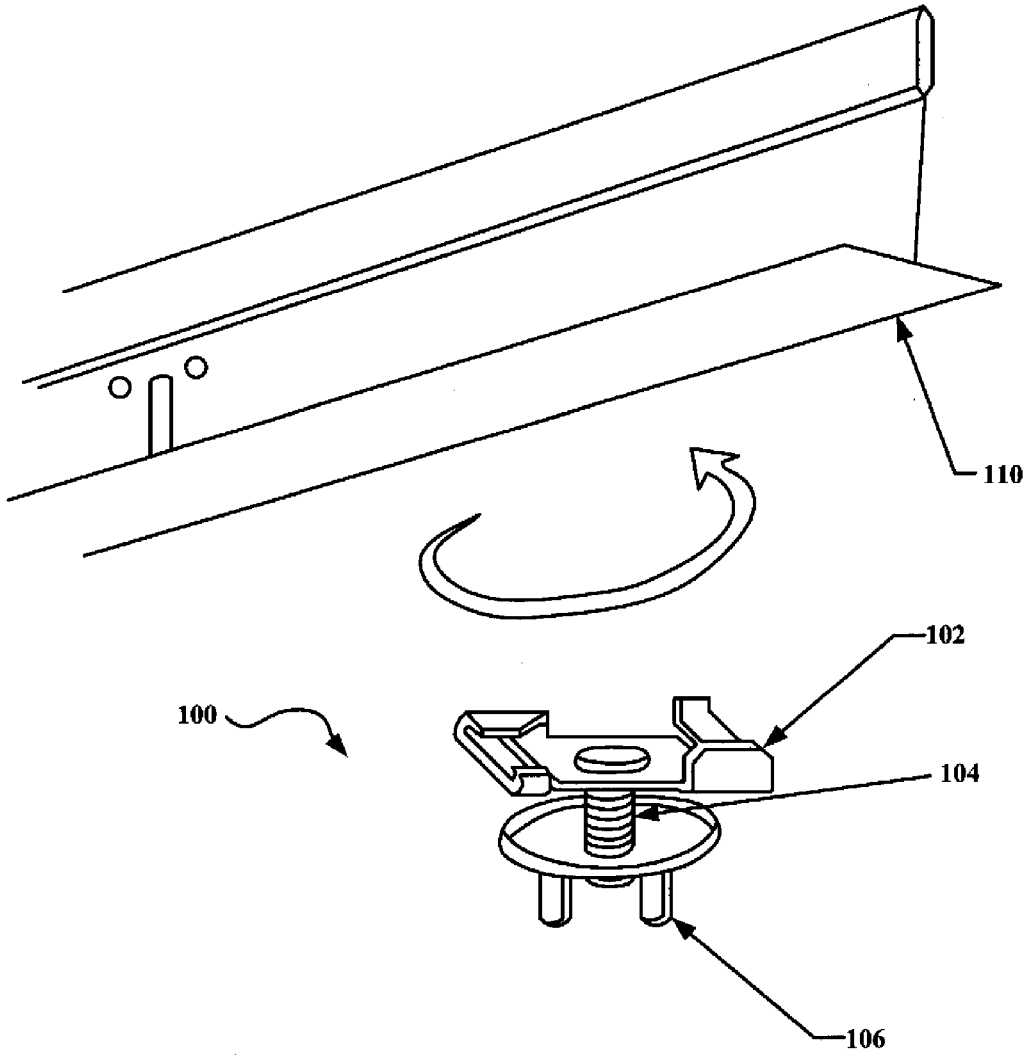
FIG. 1 (Prior Art)
FIG. 1 is an isometric view of a first connector assembly for securing items to a ceiling grid.
Figure 2:
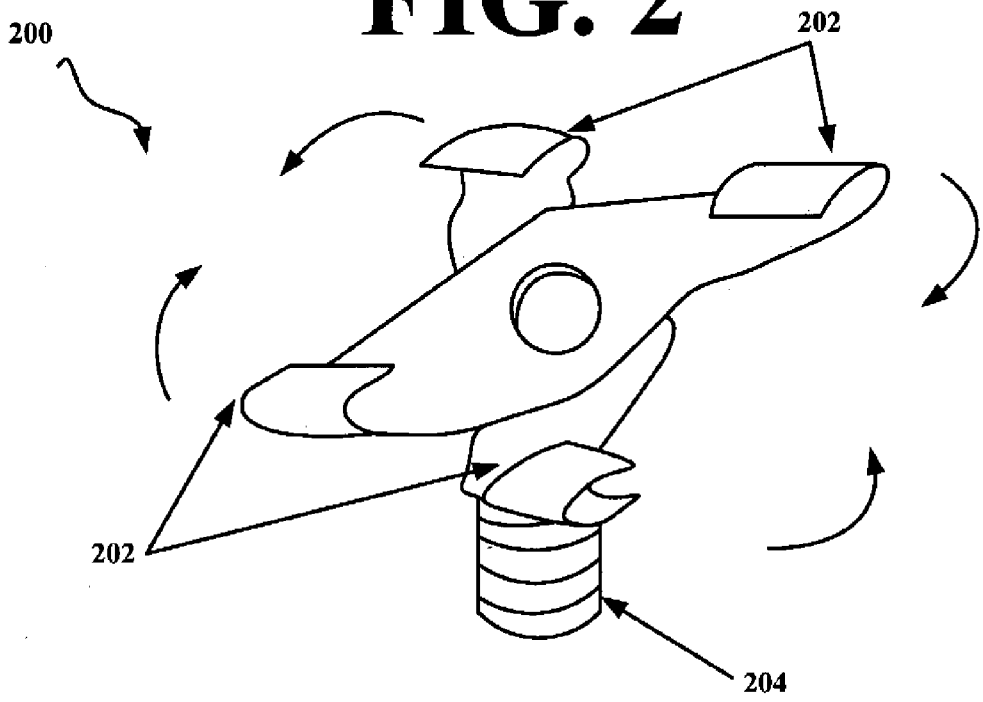
FIG. 2 is an isometric view of a second connector assembly for securing items to a ceiling grid in accordance with a first exemplary embodiment of the invention.

FIG. 2 is an isometric view of a second connector assembly 200 for securing items to a ceiling grid in accordance with a first exemplary embodiment of the invention. The connector assembly 200 has a grasping portion 202, a downwardly directed threaded rod portion 204, and a fastener (not shown). The connector assembly 200 may be secured to a "T" bar 110 by rotating the grasping portion 202 as shown. Items may be secured to the connector assembly 200 using the fastener. A variety of fasteners can be used to secure an item to the connector assembly 200 for example, but not limited to, a wing nut or other nut. Items also may be coupled to the connector assembly by other securing methods for example, but not limited to, rivets, adhesives, snaps, clips, screws, or welds.

In addition to using the fastener to couple items to the threaded rod portion 204 of the connector assembly 200, the fastener can also be used to apply pressure to the grasping portions 202. The pressure applied to the grasping portions 202 prevents the grasping portions from rotating and becoming disengaged from the "T" bar 110. The connector assembly 200 may be coupled to the "T" bar 110 by rotating the grasping portion 202 as shown prior to tightening the fastener. By tightening the fastener down on the threaded rod portion 204 against the grasping portion 202, the grasping portion 202 is secured to the "T" bar 110 and is prevented from rotating by the pressure applied by the fastener.

Figure 3:
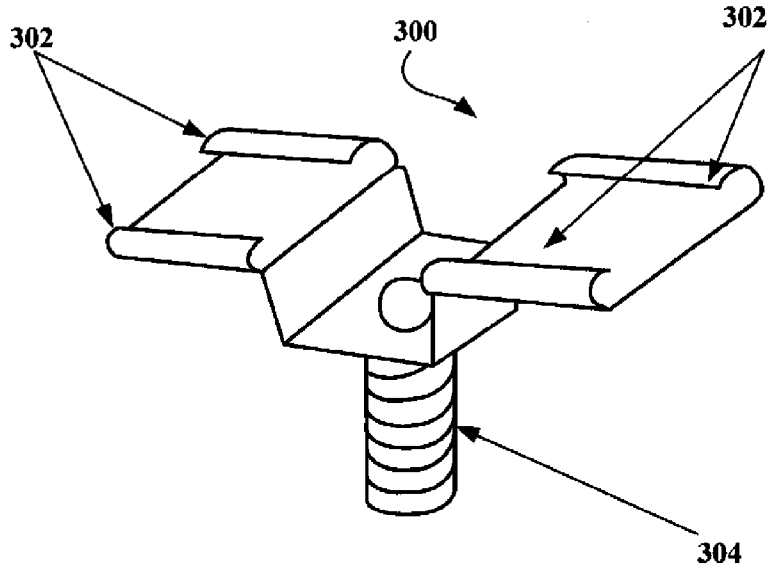
FIG. 3 is an isometric view of a third connector assembly for securing items to a ceiling grid in accordance with a second exemplary embodiment of the invention.

FIG. 3 is an isometric view of a third connector assembly 300 for securing items to a ceiling grid in accordance with a second exemplary embodiment of the invention. The connector assembly 300 has a grasping portion 302, a downwardly directed threaded rod portion 304, and a wing nut (not shown). The connector assembly 300 may be secured to a "T" bar 110 by sliding the grasping portion 302 over an end of the "T" bar 110. Items may be secured to the connector assembly 300 using the fastener or other securing methods previously discussed in regards to the second connector assembly 200.

Figure 4:
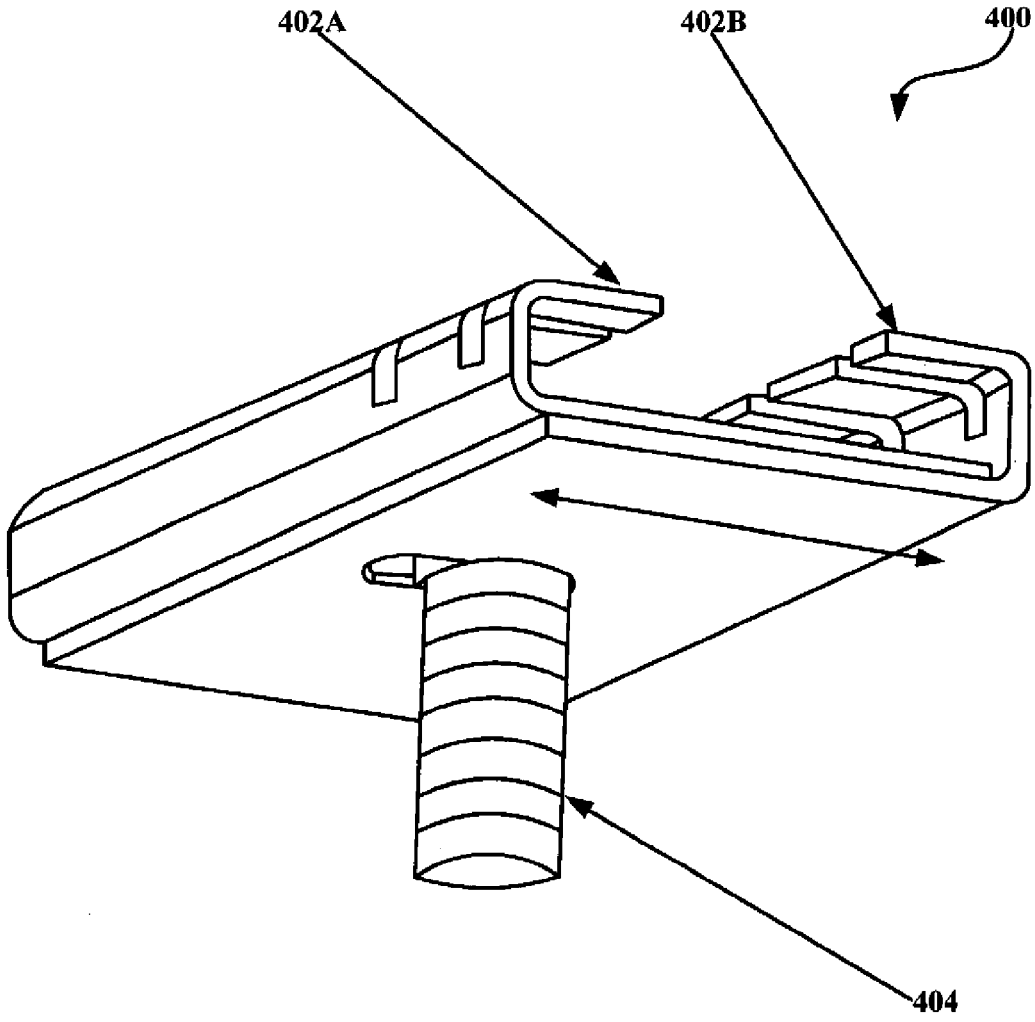
FIG. 4 is an isometric view of a fourth connector assembly for securing items to a ceiling grid in accordance with a third exemplary embodiment of the invention.

FIG. 4 is an isometric view of a fourth connector assembly 400 for securing items to a ceiling grid in accordance with a third exemplary embodiment of the invention. The connector assembly 400 has cooperating grasping portions 402A, 402B, a downwardly directed threaded rod portion 404, and a wing nut (not shown). The connector assembly 400 may be secured to a "T" bar 110 by separating the grasping portions 402A, 402B in an outward direction as shown by the arrow in FIG. 4. The "T" bar 110 is inserted between the grasping portions 402A, 402B and then the grasping portions 402A, 402B are moved back together. Items may be secured to the connector assembly 400 using the fastener or other methods previously discussed in regards to the second connector assembly 200. In addition to using the fastener to couple items to the threaded rod portion 404 of the connector assembly 400, the fastener can also be used to apply pressure to the grasping portions 402A and 402B as previously discussed in regards to the second connector assembly 200.

Figure 5:
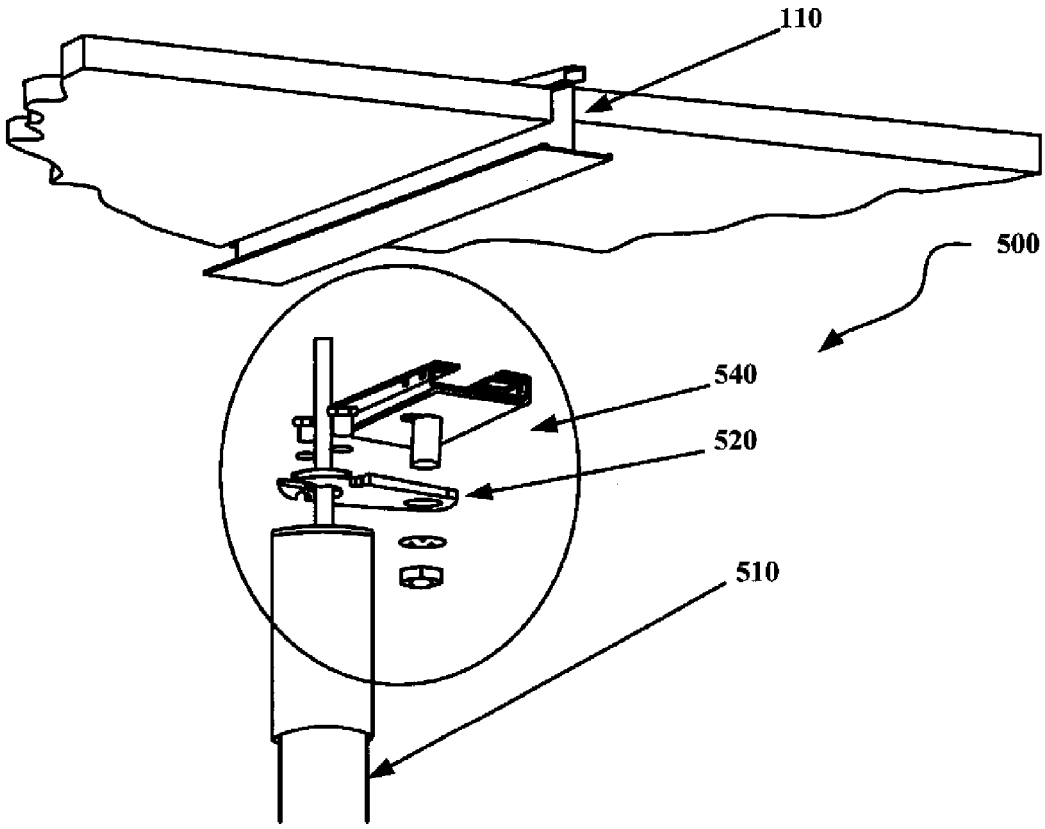
FIG. 5 is an exploded isometric view of an antenna mounting assembly in accordance with a first exemplary embodiment of the invention.
Figure 6:
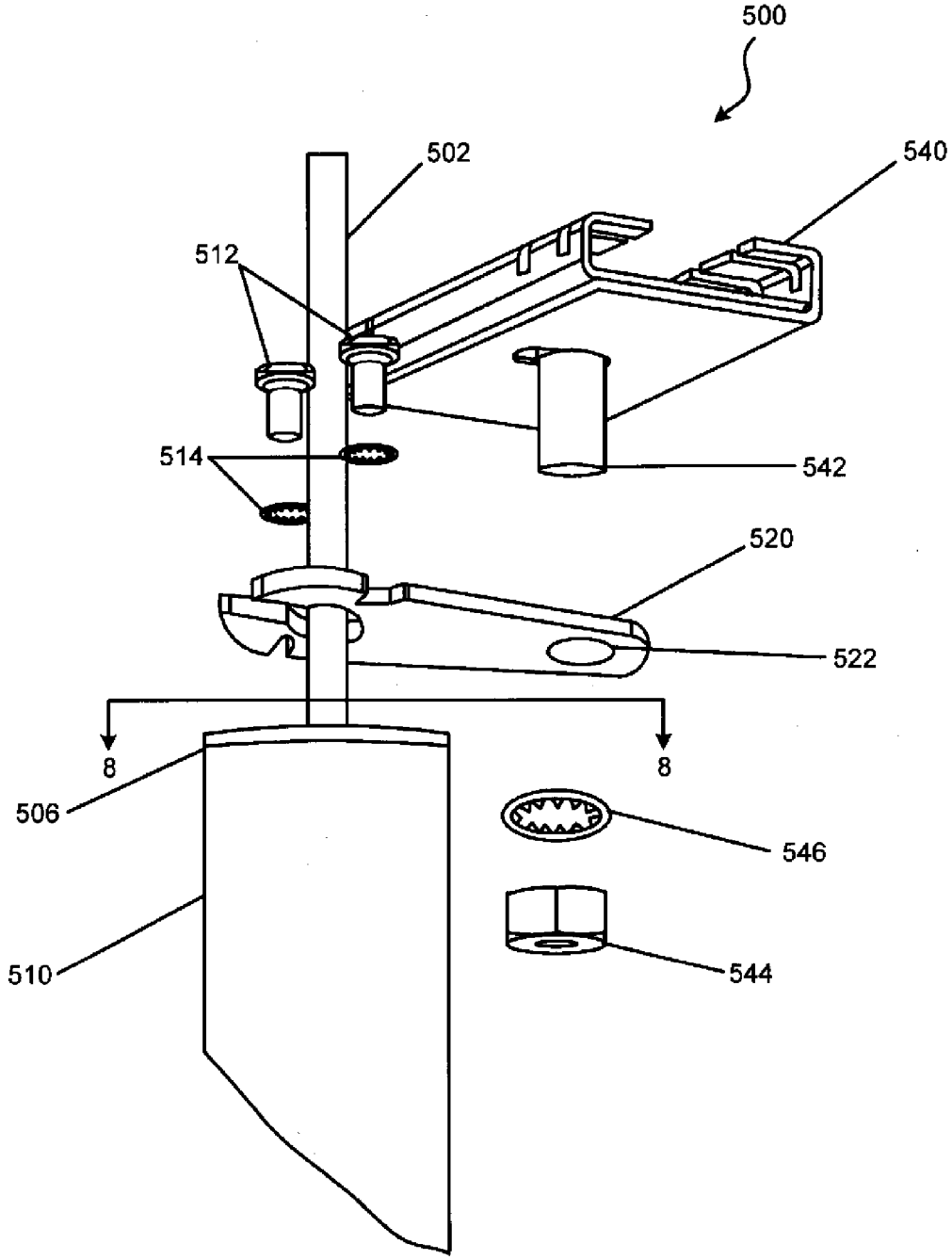
FIG. 6 is an enlarged view of the antenna mounting assembly of FIG. 5.
Figure 7:
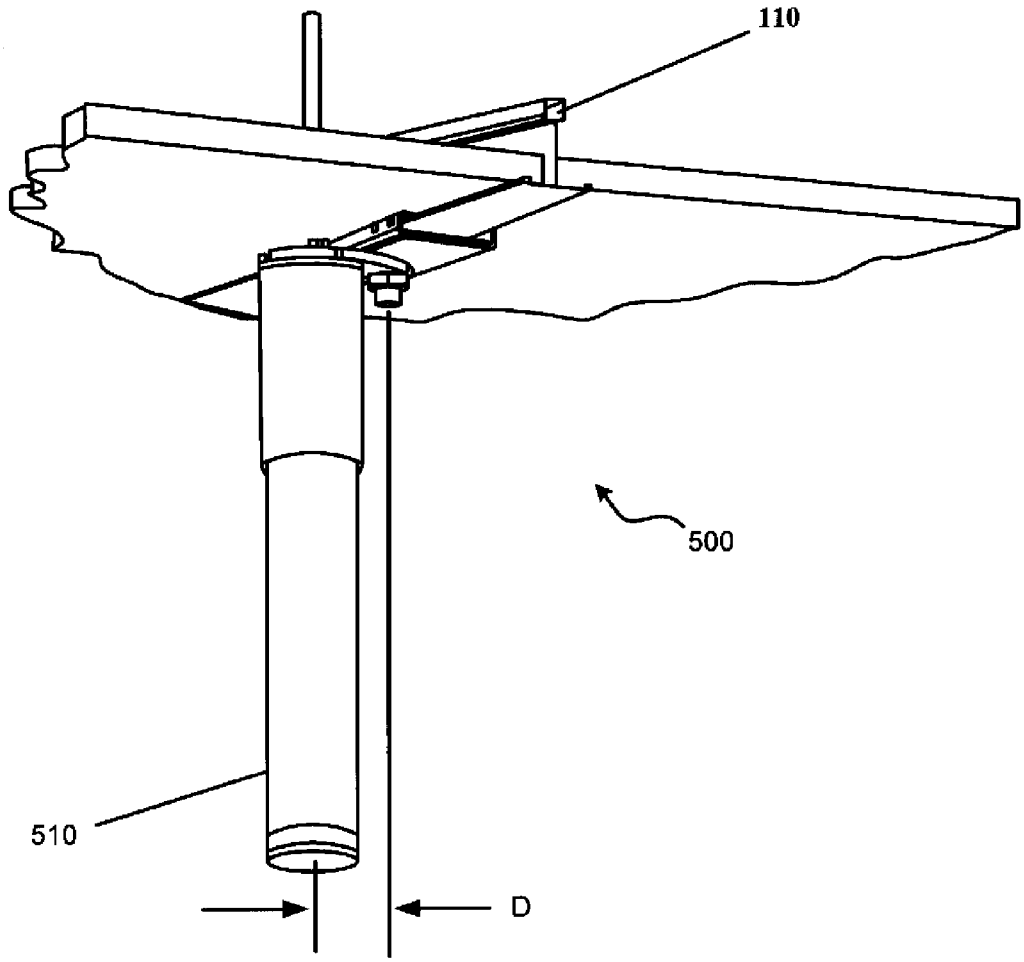
FIG. 7 is an assembled isometric view of the antenna mounting assembly of FIG. 5.

FIG. 5 is an exploded isometric view of an antenna assembly 500 in accordance with a first exemplary embodiment of the invention, FIG. 6 is an enlarged view of the antenna mounting assembly of FIG. 5, and FIG. 7 is an assembled isometric view of the antenna mounting assembly of FIG. 5. The antenna assembly 500 may include an antenna casing 510, a mounting bracket 520, and a connector assembly 540. The antenna casing 510 may conform to an elongated cylinder with an electrical connection 502 extending out a distal end 506. The electrical connection 502 connects to an antenna (not shown) located within the antenna casing 510. The antenna and antenna casing 510 may be available from Cushcraft Corporation of Manchester, N.H. Alternatively, the electrical connection 502 may extend through a bushing 550 having external threads (as shown in FIG. 8).

The connector assembly 540 may be any connector with a downwardly extending threaded rod 542 that is capable of being coupled to a ceiling grid for example, but not limited to, the connector assemblies 100, 200, 300, and 400 shown in FIGS. 1, 2, 3, and 4.

Figure 8:
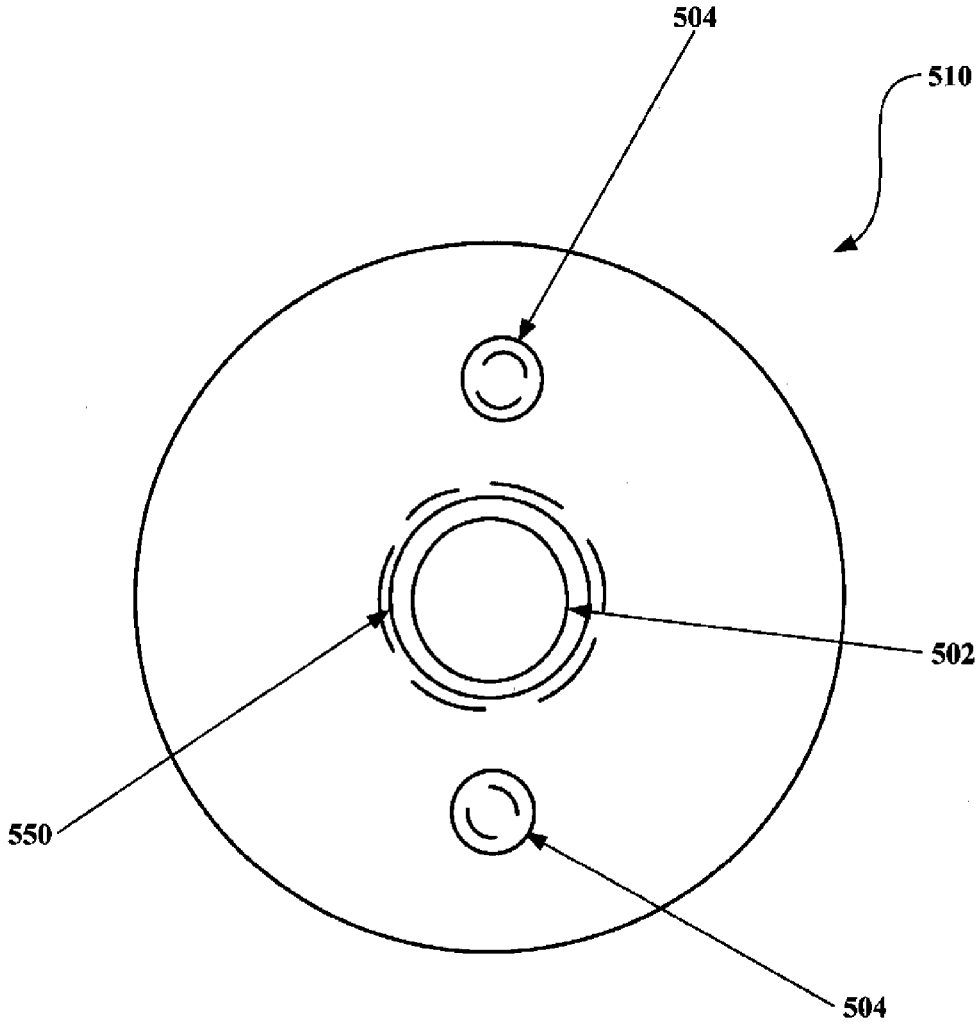
FIG. 8 is an end view of an antenna in accordance with a first exemplary embodiment of the invention through line 8—8 in FIG. 6.

FIG. 8 is an end view of an antenna casing 510 in accordance with a first exemplary embodiment of the invention taken through line 8—8 in FIG. 6. The antenna casing 510 may have one or more female threaded inserts 504. Alternatively, the antenna casing 510 may have projecting threaded rods extending upwardly from the distal end 506 without departing from the present invention.

Figure 9:
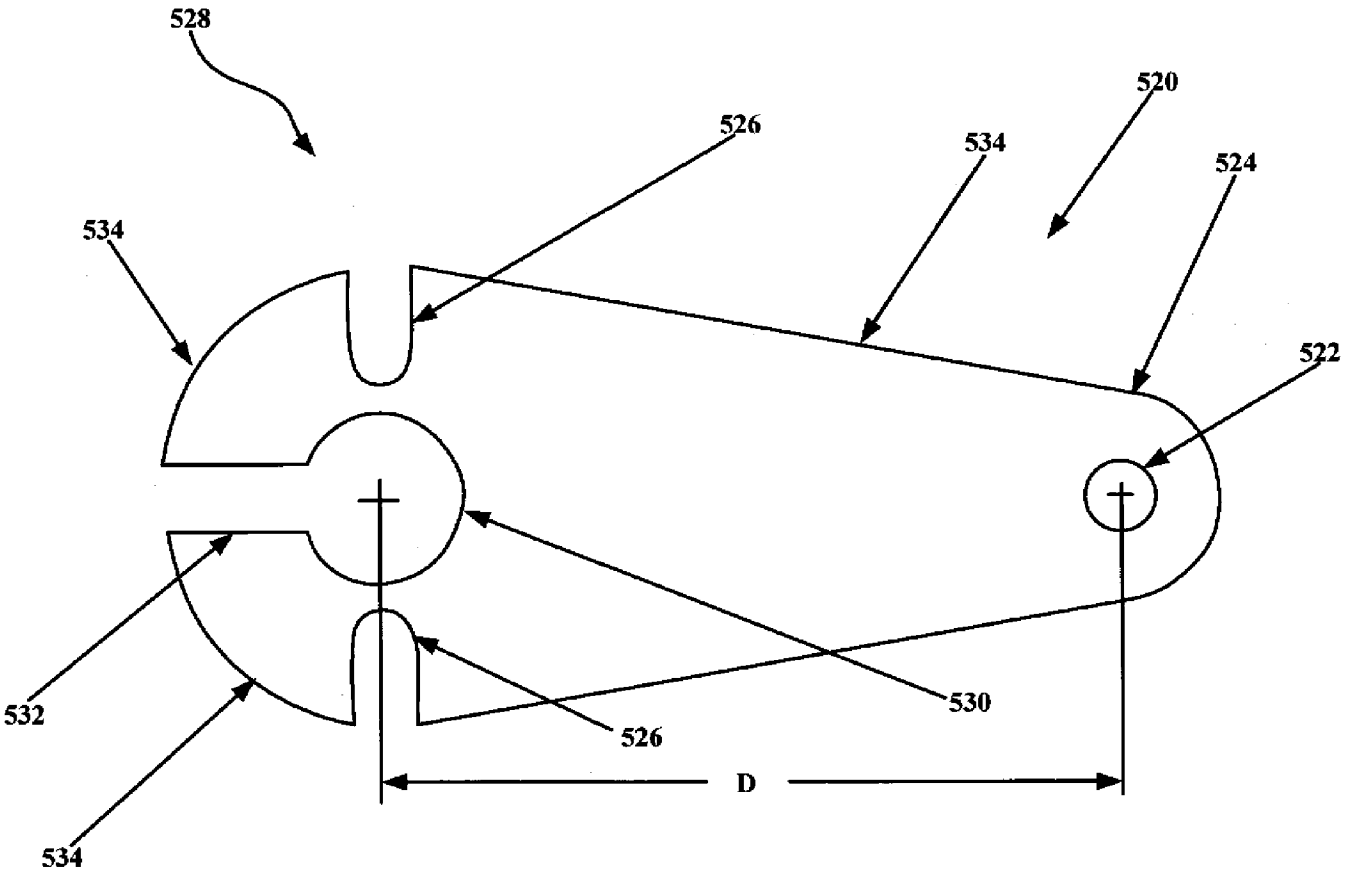
FIG. 9 is a top view of an antenna bracket in accordance with a first exemplary embodiment of the invention.

FIG. 9 is a top view of an antenna-mounting bracket in accordance with a first exemplary embodiment of the invention. The antenna mounting bracket 520 may be a generally flat plate having a first opening 522 at a proximal end 524, one or more second openings 526 at a distal end 528, a third opening 530 at the distal end 528, and a slot 532 extending outwardly from the third opening 530 to an outside edge 534. The first opening 522 and the one or more second openings 526 may extend to the outside edge 534 without departing from the present invention. The first opening 522 is spaced from the third opening 530 by a distance "D." The first opening 522 may be sized to allow the threaded rod portion 542 from the connector assembly 540 to extend therethrough. The one or more second openings 526 may be spaced to align with the female threaded inserts 504 in the end 506 of the antenna casing 510. The third opening 530 may be sized to allow the electrical connection 502 of the antenna casing 510 to extend therethrough.

As shown in FIGS. 5–7, the mounting bracket 520 may be secured to the connector assembly 540 using a nut 544 and a lock washer 546 coupled to the threaded rod portion 542 of the connector assembly 540 through the first opening 522 in the mounting bracket 520. The antenna casing 510 may be secured to the mounting bracket 520 using a screw 512 and lock washer 514 inserted through the one or more second openings 526 in the bracket 520 and into the threaded inserts 504 disposed in the distal end 506 of the antenna casing 510. The outwardly extending slot 532 may allow the antenna casing 510 to be coupled to the mounting bracket 520 without having to thread the electrical connection 502 through the third opening 530. When assembled, the electrical connection 502 may extend vertically without hitting the "T" bar 110. The electrical connection 502 may be offset from a center line of the "T" bar 110 by the distance "D".

In an alternative embodiment, the antenna 510 may be secured to the mounting bracket 520 using a nut (not shown) and a lock washer (not shown) inserted over a projecting threaded rod (not shown) extending axially from the antenna casing 510.

In another alternative embodiment, the antenna casing 510 may be secured to the mounting bracket 520 using a nut (not shown) threaded over the external threads of the bushing 550. The antenna casing 510 is not limited to being secured to the bracket 520 in the above embodiments. A variety of other fasteners and coupling methods can be used to secure the antenna casing 510 to the mounting bracket 520. For example, the antenna casing 510 may be coupled to the mounting bracket 520 by other securing methods for example, but not limited to, rivets, adhesives, snaps, clips, screws, or welds.

In addition to constructing the components of the antenna-mounting bracket 500 separately, the various components may be cast or molded as a single piece. For example, the connector assembly 540 and mounting bracket 504 may be molded as a single component. In this example the mounting bracket 504 may not have a first opening 522. In another example, the antenna casing 510 may be cast or molded with the mounting bracket. In this example the mounting bracket 504 may not have the second openings 526 and third opening 530.

It should be emphasized that the above-described embodiments of the invention are merely some possible examples of implementation, set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

We claim:

1. An antenna mounting assembly, comprising:

a connector assembly;

a mounting bracket, wherein the mounting bracket has a first opening at a proximal end of the bracket, a second opening at a distal end of the bracket, and a slot extending outwardly from the second opening to an outside edge of the bracket; and a threaded rod connected to the connector assembly and to the mounting bracket.

2. The antenna assembly of claim 1, wherein the connector assembly is connected to a hung ceiling T-bar and wherein the first opening is spaced from the second opening at least half of a width of the T-bar, thereby allowing an antenna electrical connection to extend vertically without being obstructed by an overhead ceiling grid when the mounting bracket is secured to the overhead ceiling grid.

3. The antenna assembly of claim 1, wherein the first opening receives the threaded rod portion of the connector assembly.

4. The antenna mounting assembly of claim 1, wherein the connector assembly further comprises two grasping portions that rotate in a clockwise direction and two grasping portions that rotate in a counterclockwise direction, thereby allowing the connector assembly to couple to an overhead ceiling grid.

5. The antenna mounting assembly of claim 1, wherein the connector assembly further comprises a first grasping portion and a second grasping portion wherein the first and second grasping portions slide toward each other thereby allowing the connector assembly to couple to an overhead ceiling grid.

6. A method of securing an antenna to an overhead ceiling grid, comprising the steps of:

coupling a connector assembly to the overhead ceiling grid, the connector assembly having a downwardly extending threaded rod portion;

coupling a bracket to the downwardly extending threaded rod portion with a fastener;

extending an electrical connection through an opening in the bracket;

coupling the antenna to the bracket with one or more fasteners extending through the bracket.

7. The method of claim 6, wherein the electrical connection extends vertically upward a spaced distance from a centerline of a "T" bracket of the overhead ceiling grid.

8. A method of securing an antenna to an overhead ceiling grid, comprising the steps of:

coupling a connector assembly to the overhead ceiling grid, the connector assembly having a downwardly extending threaded rod portion;

coupling a bracket to the downwardly extending threaded rod portion with a fastener;

extending an electrical connection with a bushing having external threads through an opening in the bracket; and coupling the antenna to the bracket with a fastener that cooperates with the external threads on the bushing.

9. A mounting assembly, comprising:

a first opening at a proximal end of a bracket;

a second opening at a distal end of the bracket;

a slot extending outwardly from the second opening to an outside edge of the bracket;

a connector assembly mounted to the bracket at the first opening, the connector assembly mounted to an overhead ceiling grid; and a threaded rod connected to the connector assembly and to the mounting bracket.

10. The mounting assembly of claim 9, wherein the first opening is spaced from the second opening, thereby allowing an antenna electrical connection to extend vertically without being obstructed by the overhead ceiling grid.

11. The mounting assembly of claim 9, wherein the first opening is sized to allow a threaded rod portion of the connector assembly to extend therethrough.

12. An antenna mounting assembly, comprising:

an antenna;

a connector assembly;

a mounting bracket integral to the connector assembly at a proximal end of the bracket, an opening at a distal end of the bracket, and a slot extending outwardly from the opening to an outside edge of the bracket; and a threaded rod connected to the connector assembly and to the mounting bracket.

13. The mounting assembly of claim 9, wherein the connector assembly and mounting bracket are constructed from a single molded material.

14. The mounting assembly of claim 9, wherein the connector assembly and mounting bracket are coupled with a fastener.

15. The antenna mounting assembly of claim 12, wherein the connector assembly further comprises one or more grasping portions that couple to an overhead ceiling grid, wherein the proximal end of the mounting bracket is spaced from the connector assembly, thereby allowing an antenna electrical connection to extend vertically without being obstructed by the overhead ceiling grid when the mounting bracket is coupled to the overhead ceiling grid.

16. An antenna mounting assembly, comprising:

a connector assembly coupled to an overhead ceiling grid, the connector assembly having a downwardly extending threaded rod portion;

a bracket coupled to the downwardly extending threaded rod portion with a fastener;

an electrical connection extending through an opening in the bracket; and an antenna coupled to the bracket with at least one fastener extending through the bracket.

17. The mounting assembly of claim 9, further comprising an antenna mounted to the bracket.

18. The antenna mounting assembly of claim 16, further comprising a bushing having external threads through an opening in the bracket.

* * * * *